United States Patent [19]

Lambert, Jr. et al.

[11] 4,349,191

[45] Sep. 14, 1982

[54] ABDOMINAL SIDEBEND MACHINE-UPPER

[76] Inventors: Lloyd J. Lambert, Jr.; Lloyd J. Lambert, Sr., both of 1538 College Ave., South Houston, Tex. 77587

[21] Appl. No.: 100,573

[22] Filed: Dec. 5, 1979

[51] Int. Cl.[3] ..... A63B 23/02; A63B 21/06; A63B 21/16

[52] U.S. Cl. ..... 272/118; 272/134

[58] Field of Search ..... 272/116–118, 272/126, 134, 144, 130, 131

[56] References Cited

U.S. PATENT DOCUMENTS

| | | | |
|---|---|---|---|
| 2,472,391 | 6/1949 | Albizu | 272/117 |
| 3,708,166 | 1/1973 | Annas | 272/118 X |
| 3,820,781 | 6/1974 | Kane | 272/117 X |
| 3,912,261 | 10/1975 | Lambert | 272/118 |
| 4,149,713 | 4/1979 | McLeod | 272/134 X |
| 4,195,834 | 4/1980 | Lambert | 272/118 |

FOREIGN PATENT DOCUMENTS

| | | | |
|---|---|---|---|
| 122994 | 8/1901 | Fed. Rep. of Germany | 272/117 |

*Primary Examiner*—Richard J. Apley
*Attorney, Agent, or Firm*—Victor J. Evans & Co.

[57] ABSTRACT

Disclosed herein is an upper abdominal sidebend machine including a base frame which carries a weight supporting cage thereon, a seating area supported by the base, a roller trackway which revolves about the seat having an upwardly extending transverse track which supports a pair of upwardly extending pads thereon whose displacement from a center area on the roller is adjustable so that an exercisor may loop one arm over the pad and one arm in front of the pad to provide an exercise in which rotation about the seat does work on the upper abdomen. The roller is connected by means of a sprocket to a plurality of weights through chains and sprockets and a cam so that the twisting motion that one undergoes in performing the exercise can be met with weighted resistance to reduce the number of repetitions required in conditioning this area of the body.

11 Claims, 3 Drawing Figures

ABDOMINAL SIDEBEND MACHINE-UPPER

BACKGROUND OF THE INVENTION

The art of weight lifting has been woefully deficient in providing a machine which takes care of the upper abdomen and side areas immediately adjacent an exerciser. Traditionally, the method for reducing or toning body muscles in that area included leaning exercises from one side to the other or sit-ups, which did not properly isolate those muscles to be serviced. Further, the person in average condition would require an extraordinarily high number of repetitions in order to provide the beneficial cellular destruction which is always associated with body building or toning.

One form of an alternative exercise which purports to provide similar benefits includes providing a barbell along the shoulder area of a person and having the arms draped thereover and providing rotation in order to reduce the number of repetitions while still stressing the desired muscles. Clearly, exercises of this type cannot safely be performed with any appreciable amount of weight since the rotation provides natural imbalances in the body geometry which can be of considerable danger when a truly effective amount of weight is provided thereupon, but more importantly one's own body is providing the resistance to limit the range of motion that is desired in the twisting exercise. Clearly, the momentum associated with providing this exercise with weights must be resisted by the body's own muscles in this type of exercise and a rotation beyond elastic limits of one's body could of course provide muscle tears, or even more serious injury.

SUMMARY OF THE INVENTION

Accordingly, the ensuing detailed description is directed to a machine characterized in that the sidebend exercise can be performed without the need for an inordinate number of repetitions since the mechanism can be safely harnessed to weights for further resistance.

A further object is to provide a machine of the character described above in which stop elements are provided on the machine itself to limit the effect of momentum that may have been acquired during an initial portion of the exercise.

Further it is an object of the present invention to provide a machine of the character described above which is safe to use, relatively inexpensive to manufacture, of durable construction, while not requiring a pre-requisite quantum of conditioning in order to use the machine for example allowing use by children and women.

It is a further object of the invention to provide a machine which is adjustable to accommodate people of various dimensions and also to provide a machine which provides weight resistance which is also adjustable.

These and other objects will be made manifest when considering the following detailed description when taken in conjunction with the drawing figures.

BRIEF DESCRIPTION OF THE PREFERRED EMBODIMENT

Figures 1, 2, 3:
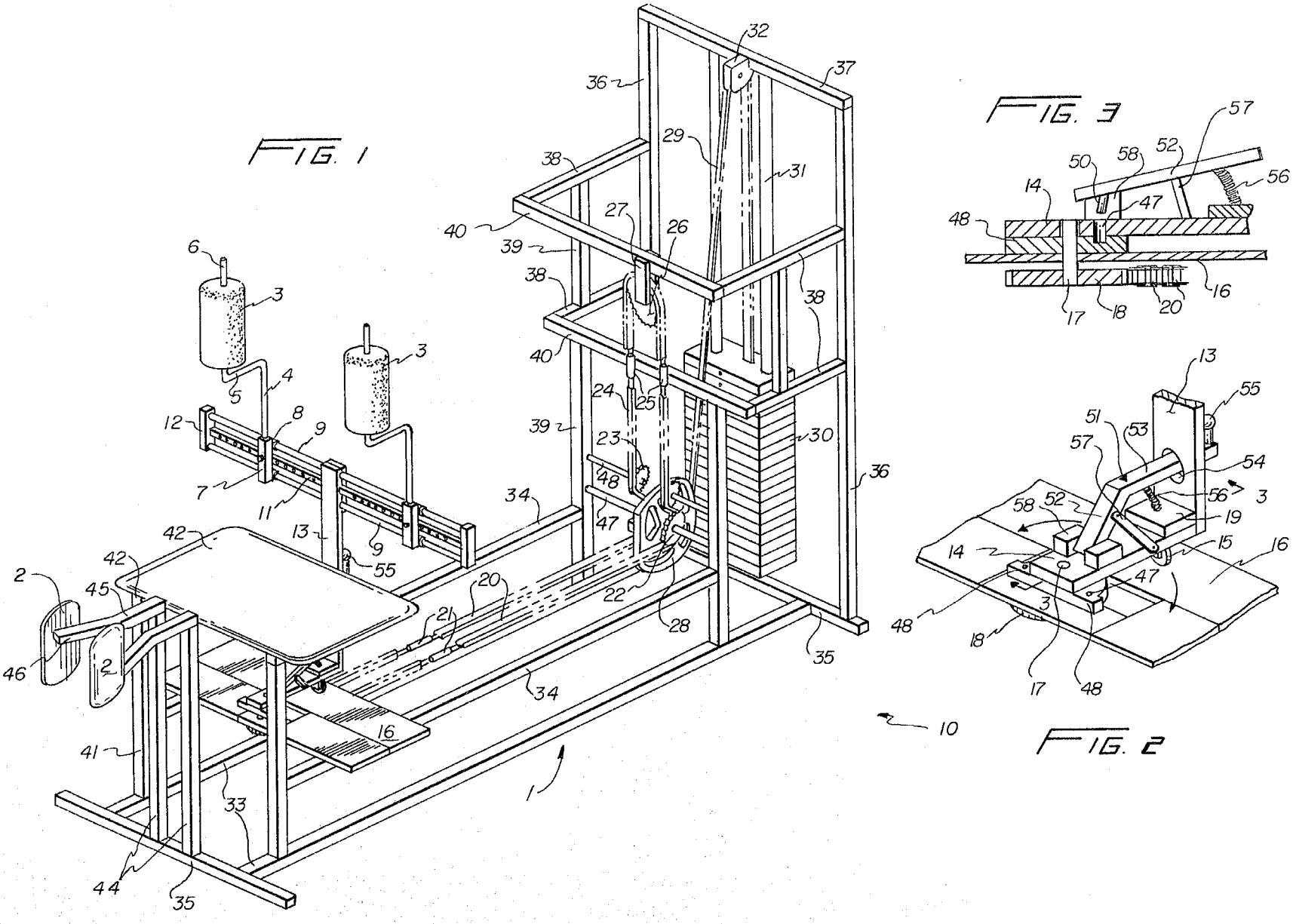
FIG. 1 is a perspective view of the apparatus according to the present invention.
FIG. 2 is a fragmentary view of the roller mechanism according to the present invention.
FIG. 3 is a sectional view taken along lines 3—3 of FIG. 2.

Referring to the drawings now, wherein like reference numerals refer to like parts throughout the several drawing figures, reference numeral 10 is directed to the upper abdominal sidebend mechanism according to the present invention.

The upper abdominal sidebend machine 10 can generally be regarded as being provided with a base frame upon which is supported at the forwardmost portion a seating framework and rearwardly a weight cage that also carries a plurality of sprockets and a cam for purposes to be assigned later. The base frame is comprised of a rectangular grid defined by two pairs of spaced parallel bars 33 and 35 orthogonally inter-connected so that the grid is of rectangular configuration. The forwardmost portion of the machine includes a pair of upstanding supports 41 connected at their topmost extremity to a seat support having a U-shaped configuration with the open end of the U attached to the elements 41. Forward of the seating area is provided a pair of leg constraints having an inverted L-shaped configuration with the vertical leg 44 being connected to the horizontal leg 45 up near the seat area, and the L-shaped configuration continues thereafter to an outwardly splayed terminus 46 upon which is provided a pair of pads 2 on either leg thereof. The seat is placed over the U-shaped frame, and the seat 42 so oriented that the roller device will traverse around the seat along the back area thereof and the side.

The roller mechanism can generally be regarded as having an L-shaped configuration with the vertical leg bearing the legend 13, the horizontal leg 14 with a brace member 19 disposed at the intersection thereof. Below a terminal portion of the horizontal leg 14 a selector 48 is provided with a downwardly extending pivot pin 17 which extends to the underside of the roller plate 16 and terminates in a sprocket 18 having chains 20 looped thereover. The selector 48 has a generally semi-circular configuration, and disposed equidistant from pivot pin 17 at least three openings 47 are provided which co-act with locking pin 50 (FIG. 2). Locking pin 50 is attached to a lockout lever 51 configured as having an angled initial portion 52 that is provided with the locking pin, a horizontal extension 53 that runs through an opening 54 in the vertical leg 13, and an handle 55. Spring 56 is disposed between horizontal extension 53 and brace member 19 to cause the lockout lever to be normally engaged, and pivot links 57 extending between 51 and 14 cooperate with guide blocks 58 carried on roller plate 14 and straddling portion 52 to provide guide means for the lockout lever.

Upwardly from the roller assembly there is provided a transverse trackway orthogonally disposed to the top terminal portion of the vertical leg 13 of the roller assembly and the transverse trackway includes a closed rectangular framework defined by a pair of laterally disposed spaced parallel cylindrical rods a interconnected by means of end caps 12. The cylindrical rods 9 have disposed therebetween an apertured transverse rod 11, and these three rods together carry and support the pads 3 as will now be explained.

The pads 3 are connected to the rods 9 and 11 by means of a Z-shaped rod having spaced off-set rod elements 4 and 6 inter-connected by means of a horizontal bar 5, and the pad 3 is disposed on the topmost bar 6, while the lowermost bar 4 is disposed within a sliding block 7 having upper and lower sleeves 8 adapted to engage the cylindrical rods 9. A medial portion of the sliding block 7 is provided with an aperture and a pin element for orientation with apertures on the cylindrical rod 11 so that when the pin is disposed therethrough, the pad 3 is locked from lateral displacement. In a preferred form, two of these devices are provided.

FIG. 2 details the roller and the roller plate and its function in the exercise machine of the instant invention, and it is to be noted that the smaller leg 14 of the roller mechanism is provided with the pivot 17 at one extremity and a downwardly disposed wheel 15 at the juncture between the vertical and horizontal legs. The wheel 15 allows the roller support legs 13 and 14 to scribe a circle in which the limits are defined by the exact placement of the locking pin 50 on either extremity of the arc of travel.

Work is therefore done by looping one's arms in a preferred form before and after each of these pads 3 and rotating the upper torso on the arc as defined by the locking pin 50. In order to increase the resistance, the sprocket 18 has provided thereon a chain 20 which extends rearwardly to a weight cage defined by upwardly extending rear support bars 36 inter-connected at their topmost extremity by a cross-piece 37, and the cross-piece 37 with the base grid 35 has extending therebetween a pair of cylindrical rods 31 upon which is slidably disposed a plurality of weights whose magnitude is adjustable by means of apertures extending through the plates which co-act with a rod extending within a central portion of the weights having apertures therein so that a pin slidably disposed therethrough will engage the appropriate amount of resistance. The weights are connected by means of a chain 29 to a sprocket 32 which lies upon the upper cross-piece 37, and the sprocket 32 is provided with a shroud for safety and appearance. Thereafter, the chain extends downwardly as at 29 and terminates on the outer face of a cam 28 supported on an axle 47. Similarly, the sprocket 18 and its chain 20 extend rearwardly to the same axle 47 and communicates with a pair of sprockets 22 spaced on either side of the cam so that rotation of the sprocket 18 causes rotation of the axle 47 and therefore of the cam causing the weight to be lifted. However, in view of the unique mechanical translation that takes place by use of the roller mechanism 13 and 14, the chain must be provided with a uniform resistance irrespective of the direction that the exerciser is taking. For this reason, the chain 20 is looped over the rear portion of the sprocket 22 and thereafter engages a second pair of sprockets 23 each of which is disposed on a second axle 48, so that the chain extends forwardly thereof and thereafter the chain extends upwardly and terminates in and connects with each other by means of the sprocket 26 as shown in FIG. 1. Sprocket 26 is connected to an upper U-shaped frame 38 by means of a bifurcated support 27 so that the open end of the U faces the weights and are fastened to the upstanding rear support bars 36 as shown. Further, a lower U-shaped brace having bar 38 connected to the support bars 36 and inter-connected by means of bars 40 by the U-shaped configuration similarly serve to support and rigidify the structure. Inteposed between the upper and lower U-shaped braces there is provided a pair of rigidifying rods 39 therebetween, reference numeral 39, and below the lower U-shaped brace a further pair of rigidifying rods 39 are provided which connect with the rectangular grid 33 so that durability of the mechanism is assured. The axles 47 and 48 are interposed between these lowermost rigidifying rods 39.

Horizontal braces 34 extend between the seat support 41 and the last named rigidifying bars 39, and it is to be noted that the roller plate 16 lies upon these horizontal braces 34 as shown in the drawings.

It is to be noted that the sprocket 18 lies in a plane orthogonal to the plane defined by the first set of sprockets 22 and similarly, the further sprocket 26 in yet the third plane. In order to allow a single chain to interconnect all these sprockets chain direction devices 21, 25 are is provided which change the direction of the plane ninety degrees.

It is to be noted therefore that the rotation of the roller assembly about the pivot 17 will cause the chain to translate around sprocket 18 which will in turn cause the cam to rotate by virtue of its interconnection on the same axle of the sprocket 22 through axle 47, and work will be done against weights. However, in order to assure that work is done in both directions whether the exerciser is going from a twisted position to an untwisted position or vice-versa, a load is maintained upon the person at all times by means of either sprocket 23 with upper sprocket 26.

The purpose of the lockout lever should now be readily apparent. When the user enters the machine, the machine at rest will appear as shown in FIG. 1 with the weights all in a rest position. Rotation of the upper torso with the machine in such a configuration would cause no resistance, of course, with all of the weights at rest. By use of the lockout lever, the "zero" position can be moved around the seat corresponding to the placement of the holes 47 on selector 48 so that the user may initiate the exercise when the zero point corresponds to a position wherein the user's body is initially twisted to one side or the other. Tests reveal that this technique is the most effective, and least likely to cause an excessive twist beyond the muscles elastic limit.

Having thus described the invention, it should be apparent that numerous structural modifications are contemplated as being a part of this invention as set forth herein above and as defined herein below by the claims.

What is claimed is:

1. An upper abdominal sidebend machine comprising in combination:

a base frame which carries a weight supporting cage thereon, a seat means supported by said base frame, roller means deployable about said seat and having at least one pad disposed thereon, wherein said pad engages substantially an upper portion of an exercisor's body above the waist, and weight means are connected to said roller means whereby when said roller means are deployed about said seat, work is done by rotating the upper torso against the weights at the waist and wherein said roller means further comprises an "L" shaped framework pivoted at an extremity of a horizontal leg of the "L", and supported by an underlying roller attached to an other extremity of said horizontal leg substantially below a vertical leg of said "L".

2. The device of claim 1 wherein said roller means further comprises adjusting means for laterally displacing said pad from a central area of said roller means.

3. The device of claim 2 wherein said adjusting means comprises a transverse trackway orthogonally disposed substantially at a top terminal portion of said vertical leg of said roller means.

4. The device of claim 3 wherein said trackway comprises a closed rectangular framework substantially medially disposed on said roller means having a pair of spaced parallel cylindrical rods transverse to said roller means, a third apertured transverse rod interposed therebetween and spaced parallel end caps at extremitites therof, and said pad is slidably disposed on said rod pair.

5. The device of claim 4 wherein said pad includes a sliding block with sleeves at top and bottom extremities thereof overlying said rod pair, and pin means extending through said sliding block adapted to engage said apertured rod and be fastened thereto.

6. The device of claim 5 wherein two pads are provided each of which are fastened to said sliding blocks through a substantially "Z" shaped rod one extremity of which engages said sliding block, the other extremity of which extends through a substantially cylindrical pad.

7. The device of claim 6 wherein said base frame comprises a rectangular grid having two pairs of spaced parallel interconnected base members, a weight supporting cage emanating upwardly therefrom defined by a pair of upwardly extending rear support bars interconnected at their topmost extremity by a crosspiece that carries said weight cage sprocket, a pair of cylindrical rods extending between said crosspiece and one base member, weights slidably disposed on said cylindrical rods, spaced upper and lower U-shaped braces whose open ends are affixed to said rear support bars, said U braces provided with a pair of rigidifying rods therebetween, said lower U brace provided with a further pair of rigidifying rods extending to said rectangular grid, said further pair carrying therebetween said first axle and said second axle, said further pair connected to said seat means through a pair of horizontal braces which carry said roller plate thereon, said seat means comprising upwardly extending supports fastened to said base grid remote from said weight cage and connecting said horizontal braces, a U-shaped bracket which supports a seat connected to a top extremity thereof, said U-shaped bracket having downwardly extending support rods connected to said roller plate and provided with bumper means to stop said roller means, and a leg constaint connected to said grid remote from said weight cage defined by a pair of upwardly extending, inverted L-shaped brackets having an outwardly splayed freestanding portion which is provided with cushions thereon to address one's legs.

8. The device of claim 1 wherein said weight means are connected to said roller means at said pivot, including: a sprocket connected to said pivot, a chain overlying said pivot extending rearwardly to a first pair of sprockets disposed on a first axle having a cam disposed therebetween, a second pair of idler sprockets disposed above said first pair on a second axle, said chain looped behind said first pair and in front of said second pair, and a medial sprocket overlying said second pair having said chain extending thereover whereby translation of said rollers means causes chain displacement and rotation of said cam, said cam connected to a second chain which extends upwardly to a sprocket supported by said weight cage thence downwardly to plural weights whose magnitude is adjustable.

9. The device of claim 8 wherein a roller plate is disposed between said roller means and said sprocket and said pivot extends therethrough.

10. The device of claim 1 wherein said roller means includes lockout means comprising a selector plate attached to said weight means through a chain driving sprocket by a pivot pin, plural openings on a selector equidistant from said pivot pin, said horizontal leg having a lockout lever including a lockout pin adapted to be inserted within one of said openings whereby only when said lockout pin is retracted from one of said openings said roller means are disengaged from said weight means.

11. The device of claim 10 wherein said lockout lever includes an angled initial portion from which said locking pin depends, which is straddled by guide blocks and provided with a pivot link to said horizontal leg, a horizontal extension integral therewith which extends through an opening in said vertical leg, and terminates in an upwardly extending handle, said lever being normally biased upwards by a spring interposed between said horizontal leg and said angled initial portion.

* * * * *